United States Patent [19]

Murofushi et al.

[11] Patent Number: 4,880,719

[45] Date of Patent: Nov. 14, 1989

[54] TWO COMPONENT ELECTROPHOTOGRAPHIC DEVELOPER

[75] Inventors: Toshiaki Murofushi; Hiroshi Nakazawa; Koichi Oyamada; Shigeo Aonuma; Yoshimi Amagai; Yasuhiro Ohya, all of Kanagawa, Japan

[73] Assignee: Fuji Xerox Co., Ltd., Tokyo, Japan

[21] Appl. No.: 212,983

[22] Filed: Jun. 29, 1988

[30] Foreign Application Priority Data

Jul. 3, 1987 [JP] Japan ..... 62-165167

[51] Int. Cl.[4] ..... G03G 9/10; G03G 9/14

[52] U.S. Cl. ..... 430/106.6; 430/108; 430/110

[58] Field of Search ..... 430/110, 106.6, 108

[56] References Cited

U.S. PATENT DOCUMENTS 4,600,675 7/1986 Iwasa et al. ..... 430/108
4,626,487 12/1986 Mitsuhashi et al. ..... 430/110 X
4,803,144 2/1989 Hosoi ..... 430/110 X

FOREIGN PATENT DOCUMENTS 3208635 9/1982 Fed. Rep. of Germany ..... 430/110
52-46820 4/1977 Japan ..... 430/110
62-10654 1/1987 Japan ..... 430/110

*Primary Examiner*—Roland E. Martin
*Attorney, Agent, or Firm*—Finnegan, Henderson, Farabow, Garrett and Dunner

[57] ABSTRACT

An electrophotographic two-component system developer is described, comprising a positive charging toner and a negative charging carrier of the dispersed magnetic powder type, wherein a hydrophilic alumina particle is adhered onto the surface of said positive charging toner and a negative charging carrier has a volume average particle diameter of from 30 to 80 μm. The developer provides reduced toner cloud upon development processing and provides toner images free from fog.

8 Claims, No Drawings

TWO COMPONENT ELECTROPHOTOGRAPHIC DEVELOPER

FIELD OF THE INVENTION

This invention relates to a developer for developing an electrostatic image in electrophotography, electrostatic recording, and the like. More particularly, it relates to an electrophotographic developer for providing a high quality image, which comprises a uniformly chargeable toner and a carrier.

BACKGROUND OF THE INVENTION

Japanese Patent Application (OPI) No. 23538/79 (the term "OPI" as used herein means an "unexamined published application) discloses use of a positive charging toner comprising positive charging $Al_2O_3$ and a negative charging core material. Japanese Patent Application (OPI) No. 92545/81 disclosed use of a positive charging toner and non-charging carrier particles.

However, the first such developer system has the disadvantage that a so-called toner cloud phenomenon occurs during use in a developing machine and causes troubles in the copying machine system. On the other hand, the second such developer system has the disadvantage that toner fog occurs on non-image areas of the copy. Further, external addition of hydrophobic silica to a positive charging toner tends to cause charging of an additional toner to the opposite polarity.

SUMMARY OF THE INVENTION

One object of this invention is to eliminate the above-described disadvantages of the conventional techniques and to provide a two component system electrophotographic developer which is protected from toner cloud and freed from fog.

As a result of extensive investigations, the inventors have found that the above object of this invention can be accomplished by a developer comprising a positive charging toner and a negative charging carrier of the dispersed magnetic powder type, wherein a hydrophilic alumina particle is adhered onto the surface of the toner.

That is, the present invention relates to an electrophotographic two-component system developer comprising a positive charging toner and a negative charging carrier of the dispersed magnetic powder type, wherein a hydrophilic alumina particle is adhered onto the surface of particle of a positive charging toner and the particle of the negative charging carrier has a volume average particle diameter of from 30 to 80 μm.

DETAILED DESCRIPTION OF THE INVENTION

The positive charging toner of the present invention has hydrophilic alumina particles adhered onto the surface of the toner particles.

The hydrophilic alumina which can be used in this invention includes fine particles of alumina which have not been subjected to surface treatment, such as Aluminum Oxide C produced by Nippon Aerosil Co., Ltd.

The average particle diameter of the hydrophilic alumina fine particles adhered to the surface of the toner particles usually ranges from 0.010 to 1.000 μm, and preferably is from 0.01 to 0.03 μm. The hydrophilic alumina fine particles are used in an amount of generally from 0.1 to 3.0% by weight and preferably from 0.8 to 2.0% by weight, based on the total weight of the toner.

Suitable binder resins of the type well known in the art can be used in the positive charging toner of the present invention. Such binder resins include homo- or copolymers of monomers selected from styrenes (e.g., styrene, chlorostyrene, vinylstyrene, etc.), olefins (e.g., ethylene, propylene, butylene, isobutylene, etc.), vinyl esters (e.g., vinyl acetate, vinyl propionate, vinyl benzoate, vinyl butyrate, etc.), esters of α-methylene aliphatic monocarboxylic acids (e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.), vinyl ethers (e.g., vinyl methyl ether, vinyl ethyl ether, vinyl butyl ether, etc.), and vinyl ketones (e.g., vinyl methyl ketone, vinyl hexyl ketone, vinyl isopropyl ketone, etc.). Particularly preferred examples of the binder resins are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a styrene-acryl-polyester polymer.

In addition to the above resins, polyester, polyurethane, epoxy resins, silicone resins, polyamide, modified rosin, paraffin, and waxes can also be employed in the toner.

However, the binder resins which can be used in the present invention is selected from the above binder resins so that in the charge due to friction, the carrier is negatively charged and the toner is positively charged.

Suitable known colorants can be used in the positive charging toner. Examples of usable colorants include carbon black, copper phthalocyanine type cyan colorants, azo-type yellow colorants, azo-type magenta colorants, quinacridone-type magenta colorants, and the like. Of these, copper phthalocyanine colorants, azo-type yellow colorants, azo-type magenta colorants and quinacridone-type magenta colorants are preferred.

If desired, the binder resin of the toner may contain other known substances, such as a charge control agent.

The positive charging toner to be used in the present invention has a volume average particle diameter of generally about 30 μm or less, and preferably from 3 to 20 μm.

The carrier used in the present invention is a negative charging carrier comprising a magnetic powder dispersed in a binder resin and having a volume average particle diameter in the range of from 30 to 80 μm, and preferably in the range from 30 to 40 μm. If the volume average particle diameter is less than 30 μm, the carrier sticks excessively to image areas together with the toner and, as a result, the developer falls short of the carrier, which causes partial disappearance of the image. On the other hand, if it exceeds 80 μm, the life of the developer is greatly shortened.

Binder resins useful in the negative charging carrier can be selected from a wide range of resins, including homo- or copolymers of styrenes (e.g., styrene, p-chlorostyrene, α-methylstyrene, etc.), esters of α-methylene aliphatic monocarboxylic acids (e.g., methyl acrylate, ethyl acrylate, n-propyl acrylate, 2-ethylhexyl acrylate, phenyl acrylate, methyl methacrylate, ethyl methacrylate, n-butyl methacrylate, 2-ethylhexyl methacrylate, phenyl methacrylate, etc.), vinyl nitriles (e.g., acrylonitrile, methacrylonitrile, etc.), vinyl ethers (e.g., vinyl methyl ether, vinyl isobutyl ether, etc.), vinyl ketones (e.g., vinymethyl ketone, vinyl ethyl ketone, methyl isopropenyl ketone, etc.), unsaturated hydrocarbons (e.g., propylene, ethylene, isoprene, butadiene, etc.), halogenated unsaturated hydrocarbons (e.g., chloroprene, etc.), etc., and combinations of two or more of the above. In addition, non-vinyl condensed resins, such as a rosin-modified phenol-formaldehyde resin, an oil-modified epoxy resin, a polyester resin, a polyurethane resin, a polyimide resin, etc., and mixtures of these non-vinyl condensed resins and the above-enumerated vinyl resins can also be used. Among these, styrenes, esters of α-methylene aliphatic monocarboxylic acid are preferred.

The magnetic powder to be dispersed in these binder resins of the carrier is a conventional magnetic powder and includes, for example, magnetide, γ-marmatite, red iron oxide, chromium oxide, nickel, manganese, iron, cobalt, nickel alloys, etc. These magnetic powders preferably have an average particle diameter ranging from 0.05 to 5 μm, more preferably from 0.1 to 1 μm. The ratio of the magnetic powder in the total carrier components preferably ranges from 30 to 80% by weight, and more preferably ranges from 50 to 75% by weight.

The negative charging carrier comprised of the above-described magnetic powder and binder resin can be prepared by various known methods. For example, the resin and the magnetic powder may be melt-kneaded by means of a Banbury mixer, a kneader, a roll mill, an extruder, or the like, and the mixture is then cooled, pulverized and classified. The carrier can also be obtained by a spray drying method comprising dispersing the magnetic powder in a resin solution followed by spray drying, or a suspension polymerization method comprising dispersing a monomer(s) constituting the binder resin and prescribed other materials in an appropriate solvent followed by suspension polymerization. The particle size of the carrier can be adjusted by controlling conditions for pulverization after melt-kneading, or by classification, or by mixing two or more kinds of previously prepared carriers having different particle size distributions to obtain a mixed carrier having a desired particle size distribution.

Also the positive charging toner of the present invention can be prepared by the same various known method as in the negative charging carrier.

The carrier particles may be mixed with the toner composition in various suitable combinations, however the best results are obtained when about 1 part by weight of the toner particles to about 10 to about 200 parts by weight of carrier particles (i.e., a ratio (parts by weight) of the toner particles to carrier particles: 1/10 to 200) are utilized.

The present invention is exemplified in greater detail with reference to the following Examples and Comparative Examples, but it should be understood that the present invention is not deemed to be limited thereto. In these examples, all the parts, ratios, and percents are by weight unless otherwise indicated.

EXAMPLE 1

A mixture consisting of 35 wt % of a dimethylaminoethyl-terminated polyester, 1 wt % of polypropylene wax, 53.6 wt % of a styrene-n-butyl methacrylate copolymer, 9.6 wt % of C.I. Pigment Red 48:1, and 0.8 wt % of C.I. Pigment Red 122 was kneaded, pulverized, and classified to obtain toner particles having an average particle diameter of 11.5 μm. Onto the resulting particles was adhered 1.5% by weight, based on the weight of the toner of hydrophilic alumina ("Aluminum Oxide C" produced by Nippon Aerosil Co., Ltd.) by means of a Henschel mixer to prepare a positive charging toner.

Separately, 30 parts by weight of a styrenebutyl methacrylate (65/35) copolymer and 70 parts by weight of magnetite ("EPT 1000" produced by Toda Kogyo Co., Ltd.) were kneaded, pulverized, and classified to obtain a negative charging carrier having a volume average particle diameter of 35 μm.

Ten parts by weight of the above toner and 90 parts by weight of the above carrier were mixed in a mixing machine to prepare a two-component system developer. A copying test was carried out using the resulting two-component system developer in an electrophotographic copying machine ("FX-7790" manufactured by Fuji Xerox Co., Ltd.). As a result, 200,000 copies having satisfactory image quality were obtained.

COMPARATIVE EXAMPLE 1

A two-component system developer was prepared in the same manner as in Example 1, except for replacing Aluminum Oxide C with 1.0 wt % of silica ("R-972 produced by Nippon Aerosil Co., Ltd.). As a result of the same running test as in Example 1, fog appeared on the 50,000th copy.

COMPARATIVE EXAMPLE 2

A two-component system developer was prepared in the same manner as in Example 1, except for changing the average particle diameter of the carrier to 25 μm. When the developer was tested in the same manner as in Example 1, the 60,000 th copy suffered partial disappearance of the image area due to shortage of the developer.

EXAMPLE 2

A two-component system developer was prepared in the same manner as in Example 1, except for replacing C.I. Pigment Red 48:1 and C.I. Pigment Red 122 with 10.4% of carbon black (Regal 330"). When the resulting developer was tested in the same manner as in Example 1, 200,000 copies having satisfactory image quality were obtained.

As described above, the electrophotographic two-component system developer according to the present invention provides reduced toner cloud upon development processing and make it possible to provide a toner image having excellent image quality, without occurring fog and suffering partial disappearance of the image area, even when used for running a number of times.

While the invention has been described in detail and with reference to specific embodiments thereof, it will be apparent to one skilled in the art that various changes and modifications can be made therein without departing from the spirit of the invention and scope thereof, which is to be determined by the appended claims and their equivalents.

What is claimed is:

1. An electrophotographic two-component system developer comprising a positive charging toner comprising a colorant in a binder resin, hydrophilic alumina particles externally added onto the surface of the toner, and a negative charging carrier comprising a magnetic powder dispersed in a binder resin, wherein said hydrophilic alumina particles are adhered onto the surface of said positive charging toner and the negative charging carrier has a volume average particle diameter of from 30 to 80 μm.

2. The electrophotographic two-component system developer as claimed in claim 1, wherein the hydrophilic alumina particles have an average particle diameter of from 0.01 to 1.000 μm 3. The electrophotographic two-component system developer as claimed in claim 1, wherein the hydrophilic alumina particles are present in an amount of from 0.1 to 3.0% by weight based on the total weight of the toner.

4. The electrophotographic two-component system developer as claimed in claim 1, wherein the hydrophilic alumina particles are present in amount of from 0.8 to 2.0% by weight based on the total weight of the toner.

5. The electrophotographic two-component system developer as claimed in claim 1, wherein said carrier has a volume average particle diameter of from 30 to 40 μm 6. The electrophotographic two-component system developer as claimed in claim 1, wherein said toner has a volume average particle diameter of about 30 μm or less.

7. The electrophotographic two-component system developer as claimed in claim 1, wherein said carrier contains a magnetic powder having an average particle diameter of from 0.05 to 5 μm in an amount of from 30 to 80% by weight based on the total weight of the carrier.

8. The electrophotographic two-component system developer comprising: particles of a negative charging carrier comprising a magnetic powder dispersed in a binder resin and having a volume average particle diameter of from 30 to 80 μm; and particles of a positive charging toner having a volume average particle diameter of about 30 μm or less and having from 0.1 to 3.0% by weight, based on the total weight of the toner, of hydrophilic alumina particle adhered onto the surface of said toner particles, said toner particles comprising a colorant in a binder resin and said alumina particles having an average particle diameter of from 0.01 to 1.000 μm.

* * * * *